US010118178B2

(12) United States Patent
Doppstadt et al.

(10) Patent No.: US 10,118,178 B2
(45) Date of Patent: Nov. 6, 2018

(54) HAMMER WITH DIVIDED HAMMER TIP

(75) Inventors: Johann Doppstadt, Velbert (DE); Horst Berger, Calbe/Saale (DE)

(73) Assignee: DOPPSTADT FAMILIENHOLDING GMBH, Velbert (DE)

( * ) Notice: Subject to any disclaimer, the term of this patent is extended or adjusted under 35 U.S.C. 154(b) by 297 days.

(21) Appl. No.: 13/878,320

(22) PCT Filed: Oct. 5, 2011

(86) PCT No.: PCT/EP2011/004963
§ 371 (c)(1),
(2), (4) Date: Jul. 8, 2013

(87) PCT Pub. No.: WO2012/045447
PCT Pub. Date: Apr. 12, 2012

(65) Prior Publication Data

US 2013/0277476 A1 Oct. 24, 2013

(30) Foreign Application Priority Data

Oct. 8, 2010 (DE) ..... 20 2010 014 029 U

(51) Int. Cl.
*B02C 13/00* (2006.01)
*B02C 13/28* (2006.01)
*B02C 18/18* (2006.01)

(52) U.S. Cl.
CPC ..... *B02C 13/28* (2013.01); *B02C 18/18* (2013.01); *B02C 13/2804* (2013.01)

(58) Field of Classification Search
CPC ..... B02C 13/00; B02C 13/04; B02C 13/28; B02C 13/2804; B02C 13/2812
USPC ..... 241/293, 294, 195
See application file for complete search history.

(56) References Cited

U.S. PATENT DOCUMENTS 3,542,302 A * 11/1970 Salzmann, Jr. ..... B27L 11/005 144/176
4,047,670 A 9/1977 Svensson
4,850,408 A * 7/1989 Carpenter ..... B27L 11/005 144/176
4,969,605 A * 11/1990 Morin ..... B02C 18/186 241/192
4,997,018 A * 3/1991 Carpenter ..... B27L 11/005 144/176
4,998,574 A * 3/1991 Beach et al. ..... 144/241
5,146,963 A * 9/1992 Carpenter et al. ..... 144/231
5,271,440 A * 12/1993 Bradstreet, Jr. ..... B27L 11/005 144/162.1

(Continued)

FOREIGN PATENT DOCUMENTS

DE 195 34 033 3/1997
DE 10 2005 023 339 11/2006

(Continued)

*Primary Examiner* — Faye Francis
(74) *Attorney, Agent, or Firm* — Jacobson Holman, PLLC.

(57) ABSTRACT

The invention relates to a hammer, in particular for comminuting devices, including a rotor and/or at least one shaft to and/or on which the hammer can be fixed. Said hammer consists of a lower body provided with a through hole which is provided to connect the hammer to the rotor and/or the shaft, and at least one cutting body which can be detachably/rigidly connected to the lower body. The cutting body of the invention includes at least two parts.

18 Claims, 6 Drawing Sheets

(56) References Cited

U.S. PATENT DOCUMENTS

Figure 1B:
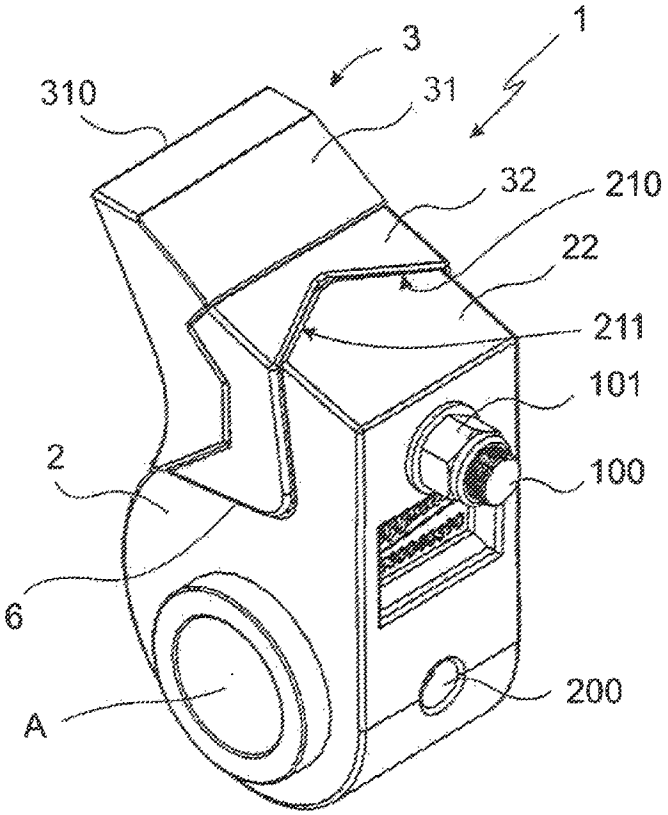

| | | | | |
|---|---|---|---|---|
| 6,227,469 | B1 * | 5/2001 | Daniels et al. | 241/186.3 |
| 6,419,173 | B2 * | 7/2002 | Balvanz et al. | 241/291 |
| 6,517,020 | B1 * | 2/2003 | Smith | 241/294 |
| 6,591,878 | B2 * | 7/2003 | Hinchliff | B27L 11/005 144/162.1 |
| 6,840,471 | B2 * | 1/2005 | Roozeboom et al. | 241/197 |
| 6,951,313 | B2 * | 10/2005 | Frick | B27L 11/005 144/218 |
| 6,971,598 | B2 * | 12/2005 | Schillinger et al. | 241/194 |
| 7,384,011 | B1 * | 6/2008 | Smith | B02C 13/06 241/294 |
| 7,938,350 | B2 | 5/2011 | Doppstadt | |
| 8,146,849 | B2 * | 4/2012 | Bacon | A01F 29/095 241/242 |
| 8,167,013 | B2 * | 5/2012 | D'Ignazio | B27G 13/04 144/176 |
| 8,231,072 | B2 * | 7/2012 | Willibald | A01B 33/08 241/294 |
| 8,844,853 | B2 * | 9/2014 | Hongo | 241/294 |
| 9,192,938 | B2 * | 11/2015 | Grover | B02C 18/0084 |
| 2002/0190148 | A1 * | 12/2002 | Roozeboom et al. | 241/189.1 |
| 2003/0042346 | A1 * | 3/2003 | Pallmann | B02C 18/06 241/294 |
| 2012/0018560 | A1 * | 1/2012 | Denis | A01G 23/00 241/282.2 |

FOREIGN PATENT DOCUMENTS

| | | |
|---|---|---|
| DE | 20 2006 019 687 | 4/2007 |
| DE | 20 2007 013 269 | 3/2009 |

* cited by examiner

HAMMER WITH DIVIDED HAMMER TIP

This is a national stage of PCT/EP11/004963 filed Oct. 5, 2011 and published in German, which has a priority of German no. 20 2010 014 029.3 filed Oct. 8, 2010, hereby incorporated by reference.

The invention refers to a hammer, in particular for comminution devices with a rotor and at least one shaft, respectively, to or on which the hammer can be fastened.

Comminution devices equipped with at least one hammer that is arranged at a rotor and a rotating shaft, respectively, in the comminution device, and that interact for comminuting the material to be comminuted with a counter blade arranged in the device are known. When maintaining comminution devices equipped with hammers, as a rule, the problem arises that the blades or the blade carriers are worn very quickly and therefore at least the blades or even the blade carriers have to be exchanged regularly. Changing the blades is here time consuming what leads to extended downtimes of the comminution device.

In the state of the art, in particular hammers of the applicant are known that are characterized in that a lower body and a cutting head interact form-fittingly to form a hammer. However, this hammer has still the disadvantage that the material share of the cutting head or cutting body is much too high compared with the total material share. The result is that producing the hammers according to the state of the art is, of course, clearly more complex, and, in particular, the spare parts for the hammer are still too expensive.

Referring to this state of the art, it is an object of the invention to suggest a hammer for comminution devices that does not have anymore the disadvantages of the state of the art, and to reduce the costs for manufacturing and maintaining the comminution device.

The invention refers to the before mentioned state of the art, and suggests a hammer, in particular for comminution devices with a rotor or at least one shaft on or at which the hammer can be fastened, consisting of a lower body provided with a through bore hole, wherein the through bore hole is provided for connecting the hammer with the rotor or the shaft, and at least one cutting body, wherein the at least one cutting body can be connected with the lower body detachably/rigidly, and the hammer is characterized in that the cutting body is formed from at least two bodies. The two-part configuration of the cutting body allows now an essentially lower material share of the wear part than so far known in the state of the art. Compared with the preceding solutions, of course, this makes maintaining more economically altogether. Furthermore, the advantages of the preceding solution in the state of the art remain according to which the cutting body can be directed universally to different cutting functions. Here, of course, the effect of wear on the hammer is such that the material share is reduced clearly because of the two-piece configuration of the cutting body. Accordingly, it is provided that the wear concerns always only the first cutting part of the cutting body, and the cutting body or the blade is only exchanged when it is worn. The result will be that, if necessary, only the part of the cutting body has to be exchanged that actually performs the cutting function. When it is worn, it can be exchanged. The material required for the blade of the cutting body is thus essentially less altogether.

The invention suggests that the cutting body is formed from at least one blade and at least one support body. This has the advantage that the blade has only to be supplied as wear part, and this can be, as already mentioned, in very different shapes for very different comminution functions. In most of the cases, the support body will not be exposed to wear. However, if this will be the case at least the lower body is not worn so that then also always the required material is less than in the state of the art. However, the configuration of the hammer according to the invention is such that always only the part of the blade projecting beyond the lower body shall be reduced in order to keep the wear as low as possible. Of course, this can be monitored in a development. As usual, the blade and the support body are provided with through bore holes, and for example connected with a through bore hole in the lower body by means of a through screw. The through bore holes are here arranged correspondingly.

According to the invention, it has been found to be an advantage when the lower body extends on its side facing the cutting body in a defined distance to a turning circle, defined by the blade tip and a turning circle of the lower body, in order to form a support area for the blade. This support area is arranged already clearly below the turning circle of the blade tip compared with the solutions of the state of the art, and is therefore already protected against a premature wear. When a support body is provided, the support area can be slightly prolonged or enlarged in the direction of the turning circle. This allows to conduct away the forces occurring during the comminuting process to or via the lower body.

It is an advantage when the cutting body comprises at least one intermediate piece as support body supporting the blade towards the support area. This is an advantageous embodiment in the shape of an intermediate piece as support body.

According to an advantageous development of the invention, in the interior of the lower body a recess is provided in which at least one connection shoulder provided at the intermediate piece engages form-fittingly. The result is here that the bodies of the lower body forming the form-fitting connection are completely protected against wear. They are, as it were, in the interior of the lower body and thus can neither be damaged nor reduced by the material to be comminuted.

It has proved here to be an advantage when the connection shoulder interacts form-fittingly with a nose provided at the lower body. This nose has proved its worth in particular in the state of the art as it transmits very conveniently the occurring forces and thus also prevents a premature wear of the lower body.

Furthermore, the invention suggests that the entire width of the cutting body and the intermediate piece, respectively, is supported on or at the lower body. This also serves for a better distribution of the forces.

In another aspect of the invention, the intermediate piece is formed such that it can be inserted in the lower body at least partly, in particular with the connection shoulder. The effect is eventually that the bodies forming the form-fitting connection between the cutting body or the intermediate piece and the lower body are protected during machining and occurring forces are safely transmitted.

According to an advantageous development of the invention, the connection shoulder can be inserted in the recess form-fittingly, self-centeringly, in particular auto-lockingly or self-lockingly. This means that the connection shoulder engages form-fittingly in the recess of the lower body. It has proven here its worth when the recess is J-shaped, seen laterally in section.

Of course, it is a fact that the connection shoulder and the recess have corresponding shapes, and are in particular interlocking, retaining one another. This serves in particular for forming a form-fitting and self-centering connection of cutting body and lower body, if necessary by means of the intermediate piece, the connection being in particular exposed to low wear. It is obvious that the recess is provided in the part of the lower body in front, seen in cutting direction.

The recess in the lower body is designed here such that it is encircled on four sides, and has in particular lateral guide bridges. The result is that the decisive part of the form-fitting connection is included in the recess, as it were, and is completely encircled on all surfaces and protected.

In order to favorably introduce the forces from the cutting body via the intermediate piece in the lower body, it is provided, according to the invention, that at least two support surfaces that are designed preferably wedge-like angled or conically designed, are provided at the support body. Conically designed means here conically tapering. These at least two support surfaces interact with counter support surfaces of the intermediate piece provided correspondingly at the support body. What is performed here is not only supporting but also centering is carried out at the same time. The support body itself has blade support surfaces on the side facing the blade, holding, supporting and centering the blade for the use as intended. Of course, they interact also with blade counter support surfaces provided at the blade, so that the result is here an entire unit, namely formed from the cutting body and the lower body, wherein it has to be taken into consideration that the cutting body is formed from at least two parts, namely the blade and the at least one support body. Of course, this design does not exclude that, if necessary, another intermediate piece may be provided. This can be an advantage for more delicate comminution tasks when the wear of the blades is not so high.

Furthermore, it has been found according to the invention to be an advantage when the blade, the intermediate piece, and the support area each are provided with a bore hole, the bore holes being arranged, when assembled, corresponding, and serving for holding a connection means, such as, for example, a screw to connect the mentioned bodies of the hammer to one another. The screw produces here in interaction with a corresponding nut the hammer as a unit in which the cutting body with the intermediate piece is fastened to the lower body.

In another aspect of the hammer according to the invention, the cutting body is formed from a blade, a support body, and a pressing piece. This embodiment allows now to further reduce the share of the blade that is subjected to wear on the entire weight of the hammer or the entire mass of the hammer. A blade is now executed as smallest element of the hammer, and a pressing piece arranged in front of the blade in cutting direction, presses the blade to the intermediate piece. Appropriate form-fitting shapes, such as elevations and/or depressions are provided in which the blade engages so that it can neither get out of place nor drop out. The support body is arranged behind the blade in cutting direction, and thus absorbs conveniently the stress arising during machining.

A development of the embodiment described is characterized in that in the pressing piece, the intermediate piece, and the support area each time a bore hole is provided, the bore holes being provided corresponding when assembled and serving for holding a fastening means, such as, for example, a screw for connecting the mentioned hammer elements to one another. The blade is here form-fittingly connected with the pressing piece and the intermediate piece by interacting with the pressing piece and the intermediate piece or being held between those form- and/or force-fittingly.

It is in particular advantageous here when the blade is designed as exchange blade with two blade tips. The effect is here that, when the first tip is worn, the exchange blade can be turned again by 180° during a maintenance period so that it has again a sharp cutting tip. Only when both cutting tips are worn, the blade is worn altogether.

In order to keep the wear as low as possible, according to an advantageous development of the invention, hardened areas, hard facings, welding-ons, hard metal coatings or the likes are provided at the edges or sides of the blades pointing in cutting direction. This does not exclude the entire blade being formed from hard metal.

It is even possible, according to the present invention, that the blade is characterized by different forms of the tip or cutting edges. A whole series of different embodiments is possible here. The invention is by now means restricted against the blades for hammers or hammer tips at hammers usually known in the state of the art.

It is also an advantage when the blade is shaped wedge-like and/or V-like in the direction of the blade tips. It has proved its worth here when, according to a development of the invention, the blade has preferably two centering elevations. Furthermore, wedge-like or V-shaped areas are provided at the blade, the areas interacting in assembled condition supportingly, centeringly and/or clampingly with the support body. This all serves for a secure installation of the blade, and, in particular, for a low wear.

Furthermore, the invention suggests that at the lower body at least one opening is provided, preferably at the side of the lower body opposite the cutting direction, and that extends at least to the through bore hole. This opening serves for holding a lubricant, such as, for example, a grease nipple through which grease can get in the through bore hole. The hammer according to the invention is equipped, as a rule, with a bush in the through bore hole, and it is necessary that the bush has also to be lubricated because of the movement. This is the reason for such a through bore hole.

The lower body and/or the cutting body are at least partly manufactured as forged/punched parts. Of course, the invention comprises also a solution where the blade is formed in one piece, and its width corresponds with the width of the cutting body.

Of course, the invention also claims a comminution device, in particular a chipper with at least one hammer as it has been described before in the very different embodiments.

Figure 1A:
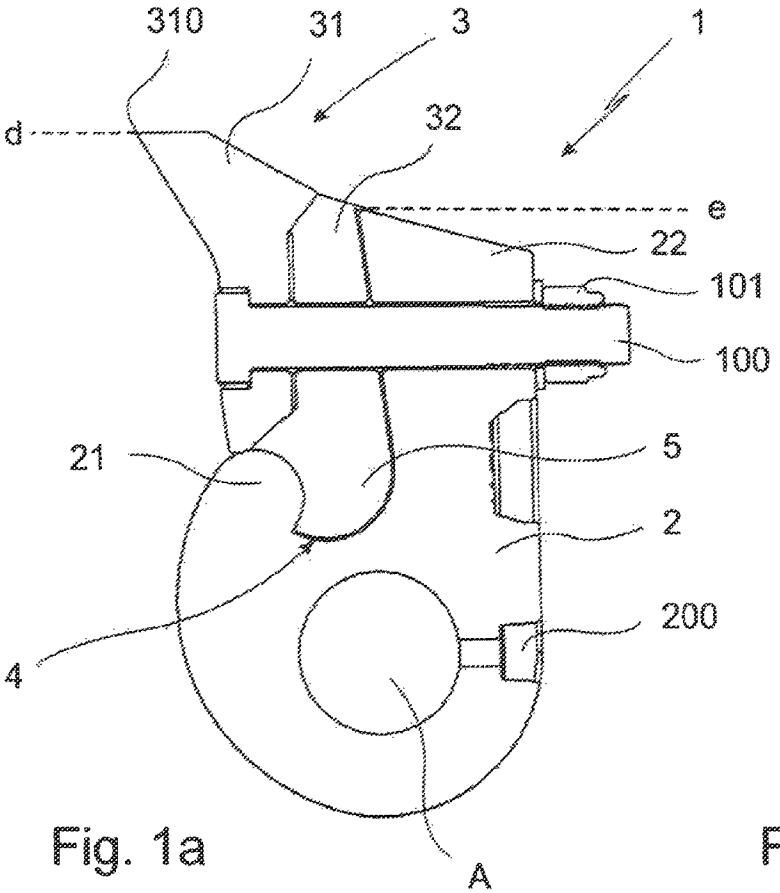
Figure 1D:
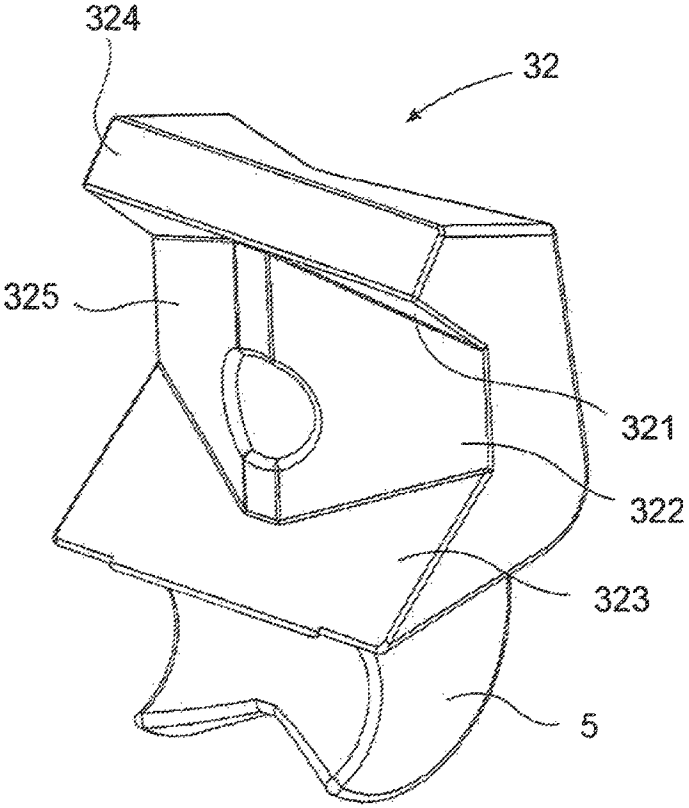
Figure 1C:
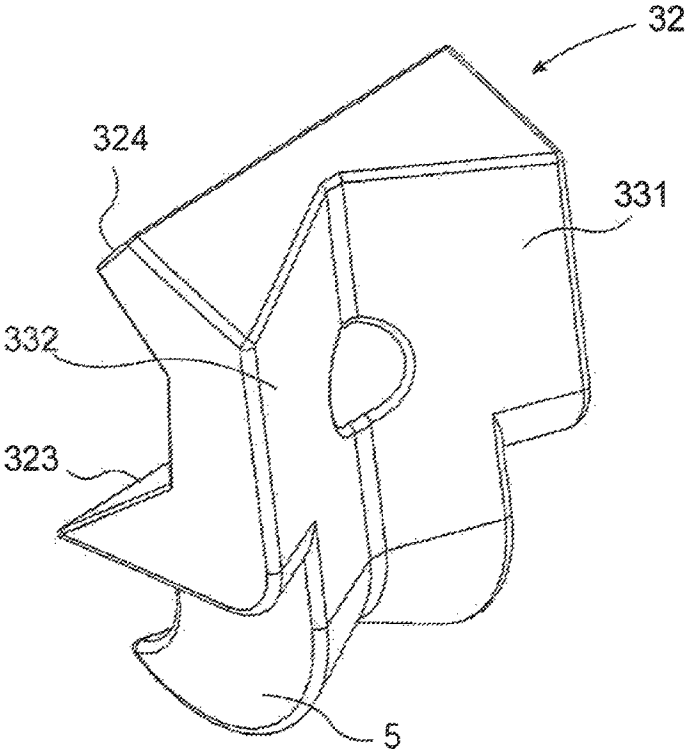
Figure 1E:
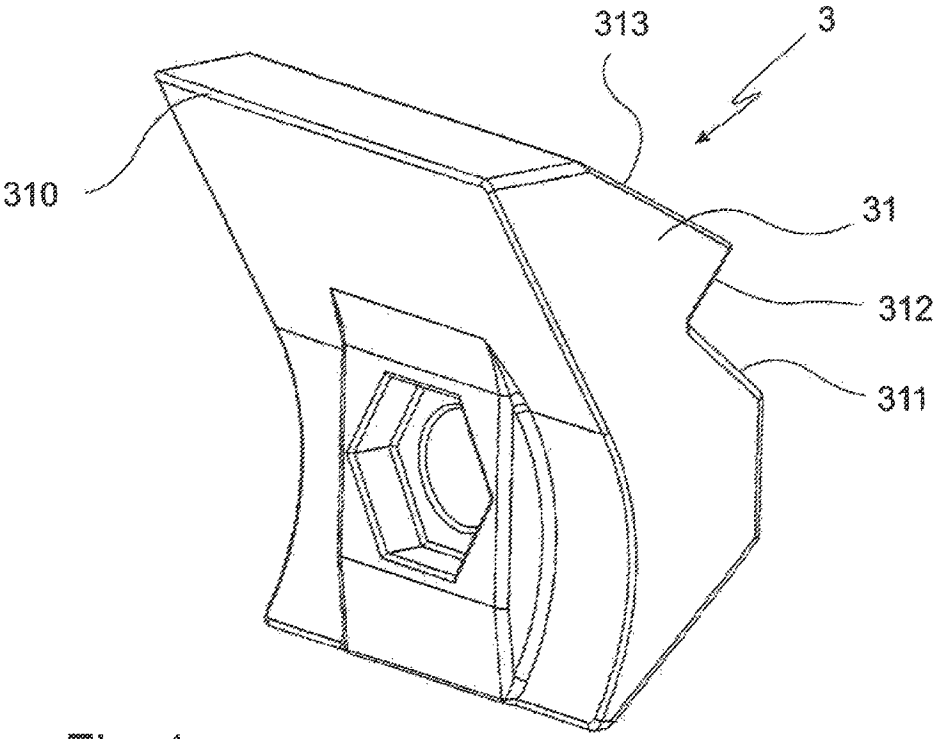
Figure 2A:
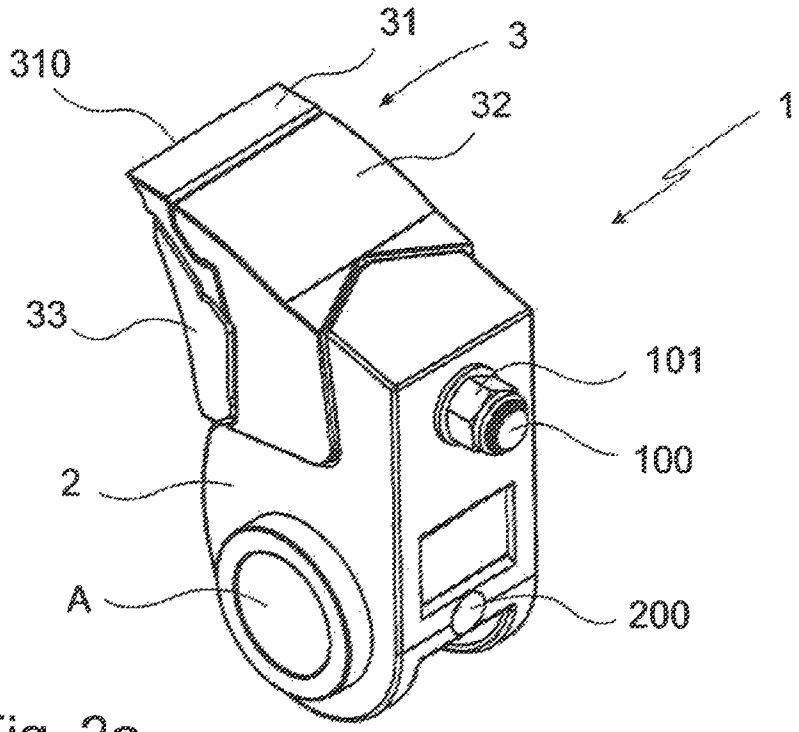
Figures 2B, 2C, 2D:
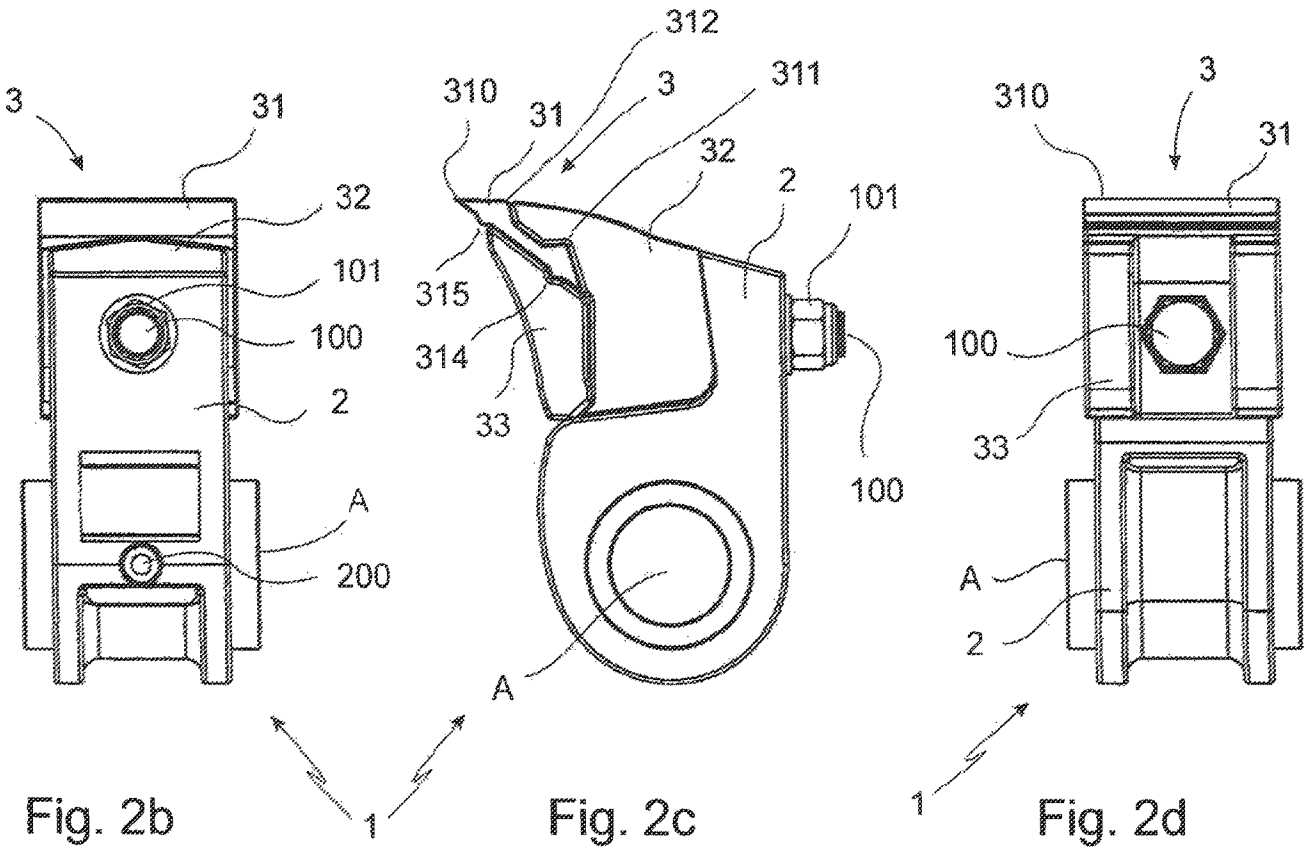
Figure 2F:
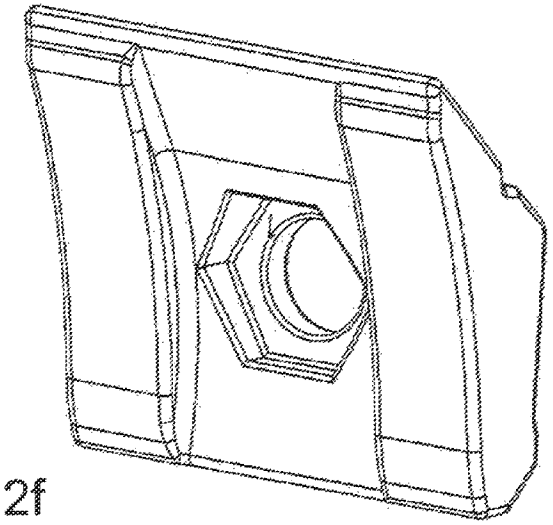
Figure 2E:
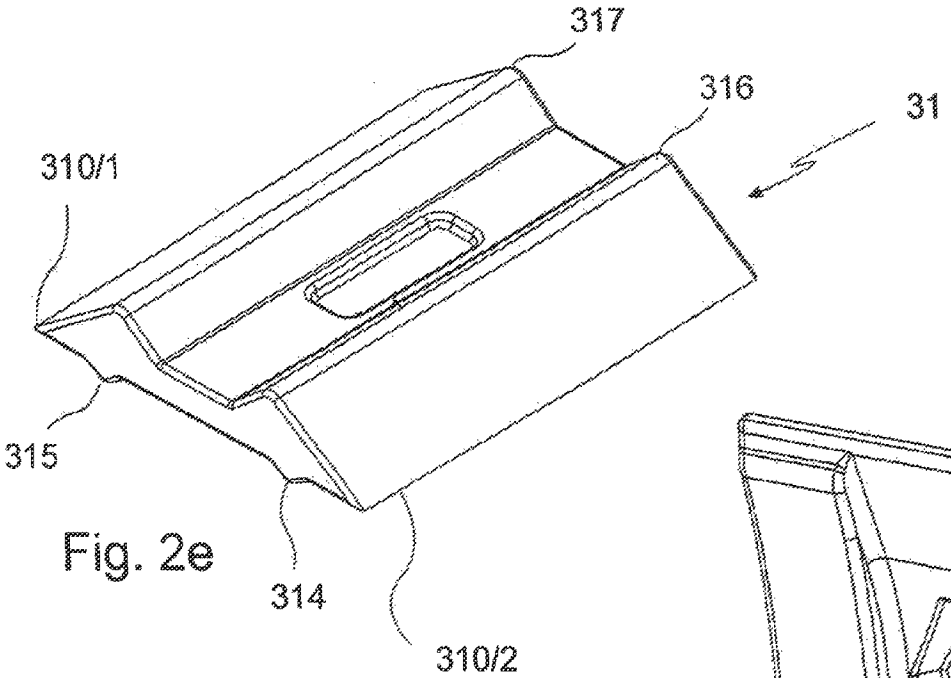

In the following, the invention will be described by means of examples. In the figures:

FIGS. 1*a* and 1*b*: hammer according to the invention in a side view and as three-dimensional representation, FIGS. 1*c* and 1*d*: support body according to the invention in different views, FIG. 1*e*: blade according to the invention in a modification, FIG. 2*a*: another embodiment of the hammer according to the invention with support body, blade, and pressing piece in a three-dimensional view, FIGS. 2*b*, 2*c* and 2*d*: hammer according to FIG. 2*a* in different views, FIGS. 2*e* and 2*f*: blade for a hammer according to FIG. 2*a* in different views.

FIGS. 1*a* and 1*b* show a hammer in a first embodiment according to the invention in a side view and in a three-dimensional representation. In the shown embodiment, hammer 1 consists of a lower body 2 with a through bore hole A for connecting the hammer 1 with the rotor or the shaft. The cutting body 3 consists of a blade 31 and at least one support body 32. As it can be seen, blade 31, support body 32, and lower body 2 are connected detachably/rigidly by means of a screw 100 designed preferably as machine screw. The screw 100 is secured with a nut 101. The bore holes in the blade 31, in the support body 32, and in the lower body 2 are here designed such that they correspond in assembled condition so that the screw 100 can be inserted without any problems.

In the chosen embodiment, the blade 31 has a blade tip 310. The blade tip 310 defines a turning circle d. At the lower body 2 a support area 22 is provided that is in assembled condition or in the shown position in the top area of the lower body 2. Here a turning circle e of the lower body is defined that is determined by the upper edge of the lower body 2 or the support area 22. A defined distance between the turning circle d of the blade and the turning circle e of the lower body now determines the reduced amount that can be reached as a maximum without damaging the lower body 2. However, it is provided conveniently that the turning circle e is located at the upper bending angle of the support body 32 as an intermediate piece. The result is that the support body 32 as the intermediate piece 32 is neither reduced nor damaged, either, when used as intended.

In the interior of the lower body 2 a recess 4 is arranged in which at least one connection shoulder 5 provided at the support body 32 as the intermediate piece engages form-fittingly. The connection shoulder 5 interacts here form-fittingly with a nose 21 provided at the lower body 2. On the side of the lower body 2 opposite the cutting direction an opening 200 is shown serving, for example, for holding a lubricating nipple. Thus lubricant can get in the through bore hole A for lubricating, if necessary, a bush that is arranged there and that is then also bored through.

FIGS. 1*c* and 1*d* show a support body 32 according to the invention in different views. It can be seen here clearly that the connection shoulder 5 is indented so that it engages in a recess 4 only indicated in FIG. 1. The recess 4 is here encircled on four sides and has lateral guide bridges 6 forming the limitation of the recess 4. In the state of the art, the connection shoulder 5 has been located directly at the blade, and thus the blade, of course, had an essentially more solid configuration. This lead in particular to high losses of material during the intended employment and the required exchange of the blades. The invention now requires only to exchange the blades 31; Support body and lower body 2 can be used repeatedly. It can be seen clearly that in FIGS. 1*c* and 1*d* appropriate blade support surfaces 321 to 325 are provided on the side facing the blade in the assembled condition for the intended use. Furthermore, support surfaces 331 and 332 are shown extending V-like tapering outwards. The configuration of the support body 32 according to the invention allows to produce a self-centering connection between the support body and the lower body 2. Reference number 324 indicates an angled surface also supporting the blade 31.

FIG. 1*e* shows an embodiment of a blade 31 according to the invention. This blade 31 is part of the cutting body 3 indicated schematically by an arrow. At the blade the blade tip 310 is pointed out, furthermore, blade counter support surfaces 311, 312, and 313 designed wedge-like opposite the cutting direction are shown.

FIG. 2*a* shows another embodiment of the hammer 1 according to the invention. However, here an even more advantageous modification of the material share and a low-wear design, respectively, is shown consisting of a support body 32, a blade 31, as well as a pressing piece 33. These three bodies, support body 32, blade 31, and pressing piece 33, form the cutting body 3. The blade 31 has here, as it can be seen, a very low material share compared with the other bodies of the hammer 1. The screw 100 connects again the bodies, the blade 31 being held here only clampingly and form-fittingly. The bore hole extends from the pressing piece 33 through the support body 32 to the lower body 2. The blade 31 is configured as exchange blade and has accordingly two blade tips 310.

FIGS. 2*b* to 2*d* show several views of the embodiment according to FIG. 2*a*. All reference numbers have already been presented, and are used here in the same way. Presenting anew is therefore not necessary.

FIGS. 2*e* and 2*f* show a blade 31 as exchange blade. It has the two blade tips 310/1 and 310/2. Furthermore, the V-shaped areas 316 and 317 are shown that are a part of the form-fitting connection to the support body 32. On the opposite side, two centering elevations 314, 315 are shown serving for interacting with the pressing piece 33.

The invention has been described before by means of examples. The claims filed now and to be filed later on along with the application are attempted formulations without prejudice for obtaining a broader protection.

References in the sub-claims refer to the further design of the matter of the main claim through the characteristics of the respective sub-claim. These are, however, not to be understood as a waiver for obtaining an independent, subjective protection for the characteristics of the referred sub-claims.

Characteristics so far only disclosed in the description can be claimed in the course of proceedings as being of inventive relevance, for example to distinguish from the state of the art.

The invention claimed is:

1. A hammer for use in a comminution device that has a rotor and a shaft to or on which the hammer can be fastened, the hammer comprising a lower body provided with a through hole, wherein the through hole is provided for connecting the hammer with the rotor and the shaft, and at least one cutting body, wherein the at least one cutting body is connected detachably with the lower body, wherein the at least one cutting body is formed of a blade, a support body and a pressing piece;

wherein the blade is positioned between the support body and the pressing piece;

wherein the lower body supports the at least one cutting body by extending between the shaft and a tip of the blade adapted to rotate around the shaft; and wherein a connection shoulder is provided at the support body, and the connection shoulder fittingly engages with a recess provided in the lower body, wherein the recess is sectionally J-shaped causing a self-locking connection when seen from a direction parallel to a rotation axis of the shaft, and the connection shoulder and the recess have corresponding shapes, and the recess is provided in a part of the lower body that engages with and receives the support body.

2. The hammer according to claim 1, wherein a connection shoulder is provided at the support body, the at least one cutting body and the support body are supported across their overall width on or at the lower body.

3. The hammer according to claim 2, wherein the support body is configured such that it can be inserted at least partly along with the connection shoulder in the lower body.

4. The hammer according to claim 1, wherein a recess is provided in the lower body, and the recess is encircled on four sides, and has lateral guide bridges, wherein the support body has at least two support surfaces that are wedge-shaped or conically tapering, and the support body interacts with counter support surfaces provided correspondingly at the support body.

5. The hammer according to claim 1, wherein blade support surfaces are provided at the support body on the support body's side facing the blade for holding, supporting and centering the blade.

6. The hammer according to claim 5, wherein at the blade, blade counter support surfaces are formed interacting with the blade support surfaces, and in the at least one cutting body and the support body, each time a bore hole is provided, the bore holes are provided correspondingly for holding a connecting means.

7. The hammer according to claim 6, wherein the connecting means is a screw.

8. The hammer according to claim 1, wherein the blade fittingly engages with the pressing piece and the support body.

9. The hammer according to claim 1, wherein the blade is configured as exchange blade with two blade tips.

10. The hammer according to claim 1, wherein at the blade at the edges and sides pointing in cutting direction hardened areas, hard facings, welding-ons, hard metal coverings are provided.

11. The hammer according to claim 1, wherein the blade is formed from hard metal.

12. The hammer according to claim 1, wherein the blade is configured wedge-shaped or V-shaped in the direction of the blade tips.

13. The hammer according to claim 1, wherein the blade has two centering elevations.

14. The hammer according to claim 1, wherein at the blade, wedge-shaped or V-shaped areas are provided to fittingly engages with the support body.

15. The hammer according to claim 1, wherein at the lower body at least one opening is provided, on the side of the lower body opposite cutting direction, extending at least to the through bore hole and serving for holding a lubricant.

16. The hammer according to claim 1, wherein the lower body and the at least one cutting body have been created at least partly as forged/punched parts, and the blade is formed in one piece and corresponds with the width of the at least one cutting body.

17. A comminution device is a chipper with at least one hammer according to claim 1.

18. A hammer for use in a comminution device that has a rotor and a shaft to or on which the hammer can be fastened, the hammer comprising a lower body provided with a through hole, wherein the through hole is provided for connecting the hammer with the rotor and the shaft, and at least one cutting body, wherein the at least one cutting body is connected detachably with the lower body, wherein the at least one cutting body is formed of a blade, a support body, and a pressing piece;

wherein the blade is positioned between the support body and the pressing piece;

wherein the lower body supports the at least one cutting body by extending between the shaft and a tip of the blade adapted to rotate around the shaft, and a recess is provided in an interior of the lower body, in which at least one connection shoulder is provided at the support body fittingly engages with the recess, and the connection shoulder fittingly engages with a nose provided at the lower body; and wherein the recess is sectionally J-shaped causing a self-locking connection when seen from a direction parallel to a rotation axis of the shaft.

* * * * *